US011653724B2

(12) United States Patent
Kanno et al.

(10) Patent No.: US 11,653,724 B2
(45) Date of Patent: May 23, 2023

(54) SNAP BUTTON AND FEMALE SNAP BUTTON

(71) Applicant: YKK CORPORATION, Tokyo (JP)

(72) Inventors: Kota Kanno, Tokyo (JP); Kazunori Somai, Tokyo (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 17/299,303

(22) PCT Filed: Dec. 7, 2018

(86) PCT No.: PCT/JP2018/045178
§ 371 (c)(1),
(2) Date: Jun. 2, 2021

(87) PCT Pub. No.: WO2020/115911
PCT Pub. Date: Jun. 11, 2020

(65) Prior Publication Data
US 2022/0053889 A1 Feb. 24, 2022

(51) Int. Cl.
*A44B 17/00* (2006.01)

(52) U.S. Cl.
CPC ..... *A44B 17/0023* (2013.01)

(58) Field of Classification Search
CPC ..... A44B 17/0023; A44B 17/0011; A44B 17/007; A44B 17/0076; A44B 17/0088
See application file for complete search history.

(56) References Cited

U.S. PATENT DOCUMENTS

| | | | | |
|---|---|---|---|---|
| 3,083,430 A | | 4/1963 | Shears et al. | |
| 4,847,959 A | * | 7/1989 | Shimada | F16B 21/078 24/671 |
| 2014/0325797 A1 | * | 11/2014 | Hasegawa | A44B 17/0041 24/108 |

FOREIGN PATENT DOCUMENTS

| | | |
|---|---|---|
| JP | S55113403 | 9/1980 |
| JP | S61136915 | 8/1986 |
| WO | 2008038743 | 4/2008 |

OTHER PUBLICATIONS

"International Search Report (Form PCT/ISA/210) of PCT/JP2018/045178," dated Mar. 5, 2019, with English translation thereof, pp. 1-5.
"Office Action of China Counterpart Application" with English translation thereof, dated May 13, 2022, p. 1-p. 11.
"Search Report of Europe Counterpart Application", dated Jun. 15, 2022, p. 1-p. 7.

* cited by examiner

*Primary Examiner* — David M Upchurch
(74) *Attorney, Agent, or Firm* — JCIPRNET

(57) ABSTRACT

Provided is a snap button including a male snap button (30) made of metal and a female snap button (10). The male snap button (30) includes a base portion (31) and an engaging protuberance (32) which projects from the base portion (31). The female snap button (10) includes: a ring member (20, 120) made of soft resin, defining an engagement space (20*a*) which detachably accepts the engaging protuberance (32); and a female snap body (11) made of metal, accommodating the ring member (20, 120). The ring member (20, 120) is provided with a protruding portion (24) which projects further out to one side than an end (12*a*), on said one side, of the female snap body (11) facing the male snap button (30) in an axial direction, and which is provided in circumferential direction.

6 Claims, 5 Drawing Sheets

SNAP BUTTON AND FEMALE SNAP BUTTON

CROSS-REFERENCE TO RELATED APPLICATION

This application is a 371 application of the international PCT application serial no. PCT/JP2018/045178, filed on Dec. 7, 2018. The entirety of each of the above-mentioned patent applications is hereby incorporated by reference herein and made a part of this specification.

TECHNICAL FIELD

The present invention relates to a snap button and female snap button, and particularly to a snap button constituted by a male snap button made of metal and a female snap button including a metal portion, and the female snap button in such a snap button.

BACKGROUND ART

A snap button constituted by a pair of a male snap button and a female snap button which can engage with and disengage from each other is often used for clothing, bags, and the like. The engagement and disengagement of the snap button is performed by an engaging protuberance of the male snap button being attached to and detached from an engagement space of the female snap button. When the male snap button and the female snap button are attached to and detached from each other, an attaching/detaching sound occurs, and particularly in a case in which both the male and female snap buttons are made of a metal, the attaching/detaching sound becomes relatively loud.

However, in clothing and the like used for hunting, bird watching, and the like, the above-described attaching/detaching sound of the snap button may hinder activity of a user.

SUMMARY OF INVENTION

Technical Problem

Therefore, an objective of the present invention is to provide a snap button and a female snap button with which it is possible for an attaching/detaching sound to be eliminated or reduced as much as possible.

Solution to Problem

To solve the above problems, according to one aspect of the present invention, there is provided a snap button including a male snap button made of metal and a female snap button, wherein the male snap button includes a base portion, and an engaging protuberance which projects from the base portion, wherein the female snap button is provided with a ring member made of soft resin defining an engagement space which detachably accepts the engaging protuberance, and a female snap body made of metal accommodating the ring member, and wherein the ring member is provided with a protruding portion which projects further out to one side than an end on the one side of the female snap body facing the male snap button in an axial direction, and which is provided in a circumferential direction.

In the present invention, the engagement and disengagement of the male snap button and the female snap button is performed by the engaging protuberance of the male snap button made of metal being attached to and detached from the engagement space of the ring member made of soft resin. Therefore, at the time of attachment/detachment, the metal engaging protuberance does not come into contact with the female snap body which is a metal portion of the female snap button, but comes into contact with only the ring member which is a soft resin portion. Further, when the engaging protuberance is inserted into the engagement space, since the protruding portion of the ring member projects further out to one side than an end furthest on the male snap button side (the one side) in the female snap body made of metal, the metal base portion can come into contact with the soft resin protruding portion, but the base portion of the male snap button does not come into contact with the female snap body made of metal. Therefore, even if the base portion which is a metal portion of the male snap button comes into contact with the protruding portion which is a soft resin portion of the female snap button when the engaging protuberance is inserted into the engagement space, the female snap body does not come into contact with the female snap body which is a metal portion of the female snap button. Therefore, in the snap button according to the present invention, an attaching/detaching sound does not occur at all or hardly occurs.

In the present invention, a height of an end which projects further out to one side than an end on the one side of the female snap body facing the male snap button in the axial direction, that is, the protruding portion of the ring member from an end furthest on the male snap button side in the female snap body, projects on the one side can be set to a height at which the base portion does come into contact with the end including tilt of the male snap button with respect to the female snap button (deviation of both axes) at the time of attachment/detachment of the snap button, for example, to 0.3 mm or more. Further, in the present invention, examples of an aspect in which the protruding portion is provided in the ring member in the circumferential direction include an aspect in which the protruding portion is continuous in an annular shape in the circumferential direction and an aspect in which a plurality of protruding portions is provided at predetermined angular intervals in the circumferential direction.

In the present invention, examples of the metal forming the male snap button and the female snap body include aluminum, an aluminum alloy, copper, a copper alloy, iron, and stainless steel, but the present invention is not limited thereto. Further, in the present invention, examples of the soft resin forming the ring member of the female snap button include elastomer resins such as a polyurethane-based resin, a polyester-based resin, a polyamide-based resin, an acrylic-based resin, a silicone-based resin, a polystyrene-based resin, a styrene-butadiene-based resin, and a nitrile butadiene-based resin, but the present invention is not limited thereto.

In one embodiment of the present invention, the female snap body includes a bottom portion, and the ring member includes a ring bottom portion which is disposed between the bottom portion and the engaging protuberance in a state in which the engaging protuberance is accepted in the engagement space. In this case, when the engaging protuberance of the male snap button is inserted into the engagement space of the female snap button, the metal engaging protuberance does not come into contact with the metal bottom portion of the female snap button.

In one embodiment of the present invention, in a state in which the engaging protuberance of the male snap button is accepted in the engagement space of the female snap button, the base portion of the male snap button is in contact with the protruding portion. In this case, when the engaging protuberance of the male snap button is inserted into the engagement space of the female snap button, the base portion of the male snap button comes into contact with the protruding portion of the female snap button, and thus further insertion of the engaging protuberance into the engagement space is prevented. In a state in which the base portion is in contact with the protruding portion of the female snap button in this way, the engaging protuberance can be in contact with or adjacent to the ring bottom portion of the ring member of the female snap button, but is not in contact with the metal bottom portion of the female snap body.

In one embodiment of the present invention, the bottom portion and the ring bottom portion each have an opening through which a shaft portion of a button fastener passes, and the shaft portion is crimped to the bottom portion or the ring bottom portion. In this case, the attachment of the female snap button to the fabric such as clothes is performed by the shaft portion of the button fastener penetrating the fabric (the shaft portion of the button fastener may pass through a hole provided in advance in the fabric), the shaft portion subsequently passing through the opening of the bottom portion of the female snap body and the opening of the ring bottom portion of the ring member (a ring opening), and then the shaft portion being crimped. The crimping of the shaft portion can be performed on the ring bottom portion as shown in FIG. 5, or can be performed on the bottom portion of the female snap body as shown in FIG. 9.

According to another aspect of the present invention, there is provided a female snap button including a ring member made of soft resin defining an engagement space, and a female snap body made of metal accommodating the ring member, wherein the ring member is provided with a protruding portion which projects further out to one side than an end on the one side of the female snap body facing a male snap button in an axial direction, and which is provided in a circumferential direction. The female snap button according to another aspect of the present invention substantially corresponds to the female snap button in the snap button according to the one aspect of the present invention described above.

In one embodiment of the present invention, the female snap body includes a bottom portion, and the ring member includes a ring bottom portion which covers the bottom portion. In this case, since the ring bottom portion covers the bottom portion of the female snap body, when the engaging protuberance of the male snap button is accepted into the engagement space of the female snap button, the metal engaging protuberance can come into contact with the soft resin ring bottom portion, but does not come into contact with the metal bottom portion.

Advantageous Effects of Invention

In the present invention, when the engaging protuberance of the male snap button is attached to and detached from the engagement space of the ring member of the female snap button, the metal engaging protuberance does not come into contact with the female snap body which is a metal portion of the female snap button, but comes into contact with only the ring member which is a soft resin portion. Further, when the engaging protuberance is accepted into the engagement space, since the protruding portion of the ring member projects further out to one side than an end furthest on the male snap button side in the female snap body made of metal, the metal base portion of the male snap button can come into contact with the soft resin protruding portion, but does not come into contact with the female snap body made of metal. Therefore, it is possible for an attaching/detaching sound to be eliminated or reduced as much as possible.

DESCRIPTION OF EMBODIMENTS

Hereinafter, preferable embodiments of the present invention will be described, but the present invention is not limited to such embodiments and can be appropriately modified within the scope of claims and the equivalent thereof.

Figure 1:
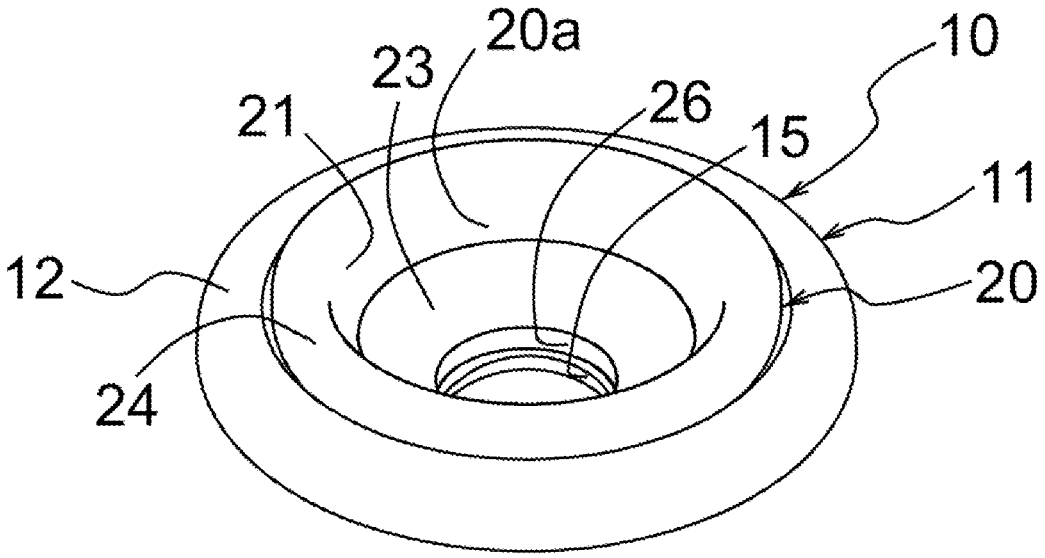
FIG. 1 is a perspective view of a female snap button according to a first embodiment of the present invention.
Figure 2:
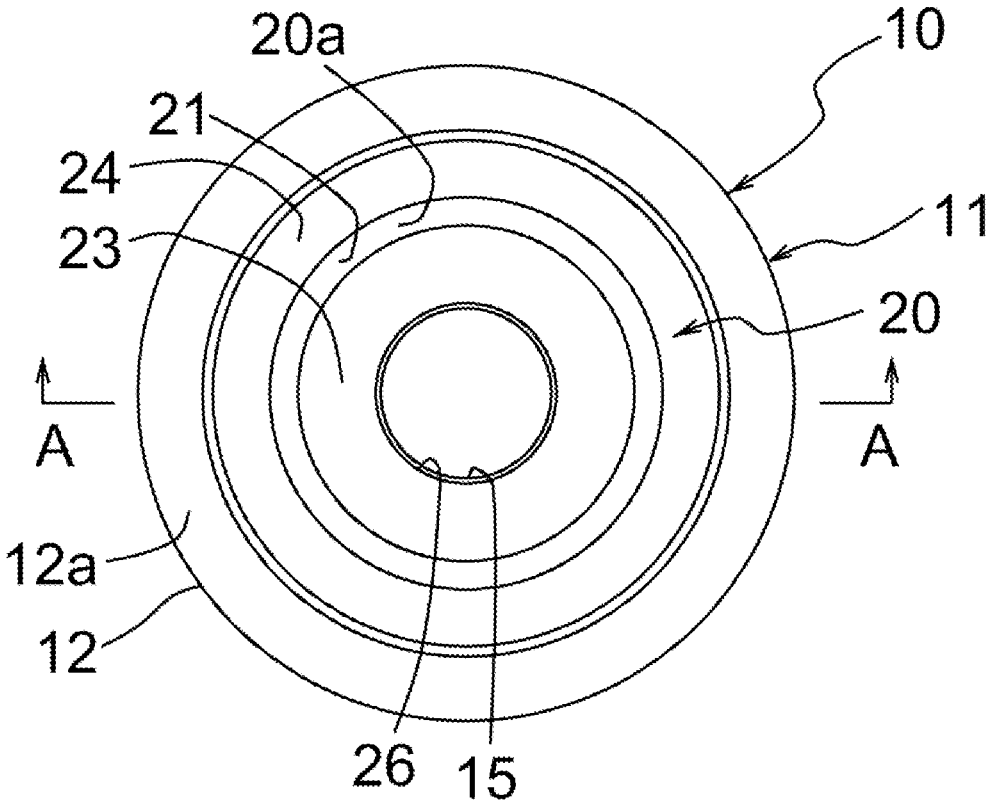
FIG. 2 is a plan view of the female snap button in FIG. 1.
Figure 3:
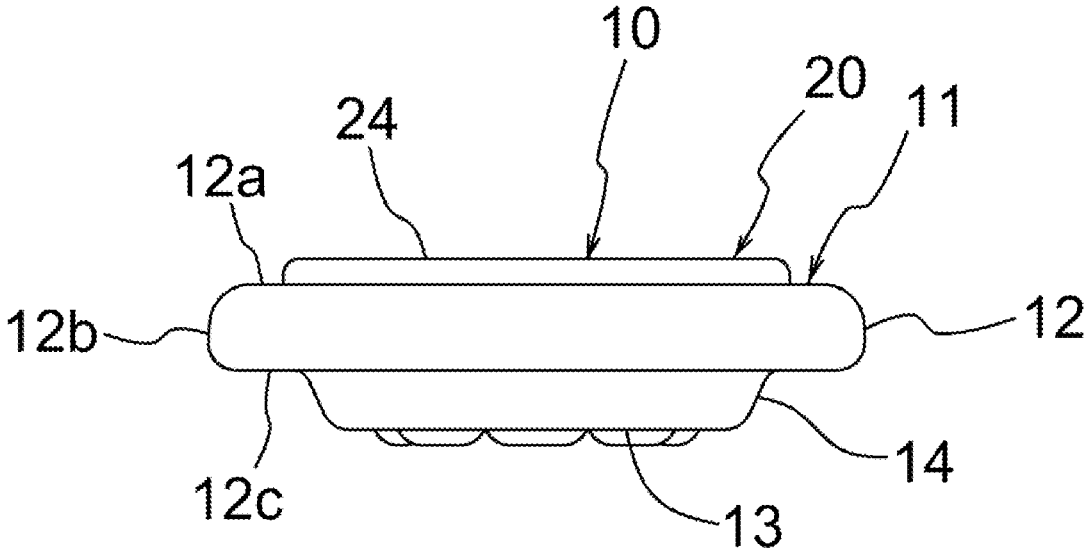
FIG. 3 is a side view of the female snap button in FIG. 1.
Figure 4:
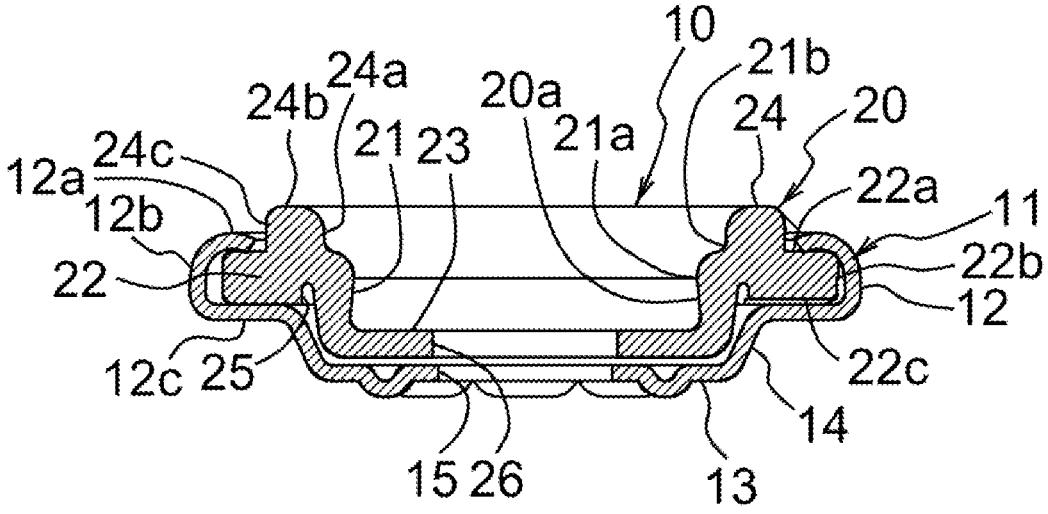
FIG. 4 is a cross-sectional view along line A-A in FIG. 2.

FIGS. 1 to 3 are a perspective view, a plan view, and a side view of a female snap button 10 (in a snap button) according to an embodiment of the present invention. FIG. 4 is a cross-sectional view along line A-A in FIG. 2. The female snap button 10 includes two members, i.e., a female snap body 11 made of metal having a substantially cuplike shape, and a ring member 20 made of soft resin which is accommodated in the female snap body 11. The ring member 20 can be flexibly and elastically deformed.

Hereinafter, an example of the female snap body 11 and the ring member 20 will be described with reference to the drawings, and in this description, a vertical direction is based on a paper surface of FIG. 4. The ring member 20 includes a cylindrical portion 21 that defines an engagement space 20*a* which detachably accepts an engaging protuberance 32 of a male snap button 30, which will be described later, an annular expansion upper portion 22 that expands outward from an upper edge of the cylindrical portion 21 in a radial direction, a ring bottom portion 23 that extends inward from a lower edge of the cylindrical portion 21 in the radial direction, and an annular protruding portion 24 that protrudes upward from an upper surface 22*a* of the expansion upper portion 22. In the present embodiment, the protruding portion 24 is continuous in a circumferential direction, but a plurality of protruding portions may be present at predetermined angular intervals in the circumferential direction. An annular slit 25 which is slightly recessed upward is present between a lower surface 22*c* of the expansion upper portion 22 and an outer peripheral surface of the cylindrical portion 21. Further, a ring opening 26 for passing a shaft portion 41 of a button fastener 40 (see FIG. 5) is provided in the center of the ring bottom portion 23.

The cylindrical portion 21 has a female-side engagement edge 21*a* having the smallest inner diameter in the vicinity of an upper edge 21*b* thereof. The inner diameter of the cylindrical portion 21 slightly and gradually expands from the female-side engagement edge 21*a* to the lower edge of the cylindrical portion 21, and an inner peripheral surface of the cylindrical portion 21 on a lower side from the female-side engagement edge 21*a* is slightly inclined outward in the radial direction toward the lower edge. An inner peripheral surface of the cylindrical portion 21 on an upper side from the female-side engagement edge 21*a* is curved outward in the radial direction to the upper edge 21*b* of the cylindrical portion 21 which is a boundary with the protruding portion 24 in a substantially stepwise shape. An outer diameter of the cylindrical portion 21 on a lower side from the slit 25 slightly and gradually decreases downward. Therefore, a thickness in the radial direction of a portion of the cylindrical portion 21 on the lower side from the slit 25 becomes thinner downward. Although not shown, the ring member 20 may not have the slit 25.

The expansion upper portion 22 has the upper surface 22*a*, a peripheral side surface 22*b*, and the lower surface 22*c* and projects outward from the protruding portion 24 in the radial direction in a substantially rectangular cross section. A thickness between the upper and lower surfaces 22*a* and 22*c* of the expansion upper portion 22 is thicker than a thickness of the ring bottom portion 23 in the vertical direction or a thickness of the cylindrical portion 21 in the radial direction. An inner peripheral surface 24*a* of the protruding portion 24 is curved outward from a lower edge thereof (the upper edge 21*b* of the cylindrical portion 21) in the radial direction toward an upper edge thereof in a substantially stepwise shape and reaches a substantially horizontal top surface 24*b* of the protruding portion 24. An outer diameter of the protruding portion 24 is substantially constant from the lower edge thereof to the vicinity of the upper edge thereof, and an outer peripheral surface 24*c* of the protruding portion 24 is perpendicular to the upper surface 22*a* of the expansion upper portion 22. Further, the outer peripheral surface 24*c* and the top surface 24*b* of the protruding portion 24 are substantially perpendicular to each other, but a corner therebetween is rounded. A projecting height of the protruding portion 24 from the upper surface 22*a* of the expansion upper portion 22 is substantially the same as or slightly smaller than the thickness of the expansion upper portion 22 in the vertical direction. The upper surface 22*a* of the expansion upper portion 22 of the protruding portion 24 is located at substantially the same position as the upper edge 21*b* of the cylindrical portion 21 in the vertical direction.

The female snap body 11 is formed using drawing processing and the like of a metal plate material and accommodates the ring member 20 to cover the ring member 20 from the outside in the radial direction and from below. The female snap body 11 includes a holding portion 12 that holds the expansion upper portion 22 of the ring member 20, a bottom portion 13 that supports the ring bottom portion 23 of the ring member 20 from below, and an annular connecting portion 14 that connects the holding portion 12 and the bottom portion 13. The holding portion 12 has an upper holding portion 12*a*, a peripheral side holding portion 12*b*, and a lower holding portion 12*c*. The upper holding portion 12*a* is an edge located at the uppermost side of the female snap body 11 (one side facing a male snap button 30). An outside portion of the expansion upper portion 22 of the ring member 20 in the radial direction is received and held between the upper holding portion 12*a* and the lower holding portion 12*c*. In this state, a slight gap is present between the peripheral side surface 22*b* of the expansion upper portion 22 and the peripheral side holding portion 12*b*. Further, the lower surface 22*c* except for the vicinity of the slit 25 of the expansion upper portion 22 is supported in contact with the lower holding portion 12*c*. The upper holding portion 12*a* is terminated in the vicinity of the protruding portion 24 in the upper surface 22*a* of the expansion upper portion 22, and a radially inside edge of the upper holding portion 12*a* is slightly separated from the outer peripheral surface 24*c* of the protruding portion 24. Although not shown, the radially inside edge of the upper holding portion 12*a* may be in contact with outer peripheral surface 24*c* of the protruding portion 24, or may be closer thereto or further separated therefrom than shown in the drawing. The protruding portion 24 of the ring member 20 projects above the upper holding portion 12*a* of the holding portion 12 located at the uppermost side in the female snap body 11. The projecting height is preferably 0.3 mm or more.

The connecting portion 14 is inclined such that inner and outer diameters thereof are reduced downward and covers the cylindrical portion 21 of the ring member 20 with a slight gap. This gap can be eliminated by the outer peripheral surface of the cylindrical portion 21 expanding outward in the radial direction and coming into contact with the connecting portion 14 in a state in which an engaging protuberance 32 of a male snap button 30 is received in the cylindrical portion 21 (see FIG. 8). An opening 15 for passing a shaft portion 41 of the button fastener 40 (see FIG. 5) is provided in the center of the bottom portion 13 to concentrically overlap the ring opening 26. In the present embodiment, a size of the ring opening 26 is substantially the same as or slightly smaller than a size of the opening 15 of the female snap body 11. Therefore, the ring bottom portion 23 covers substantially the entire upper surface of the bottom portion 13.

Figure 5:
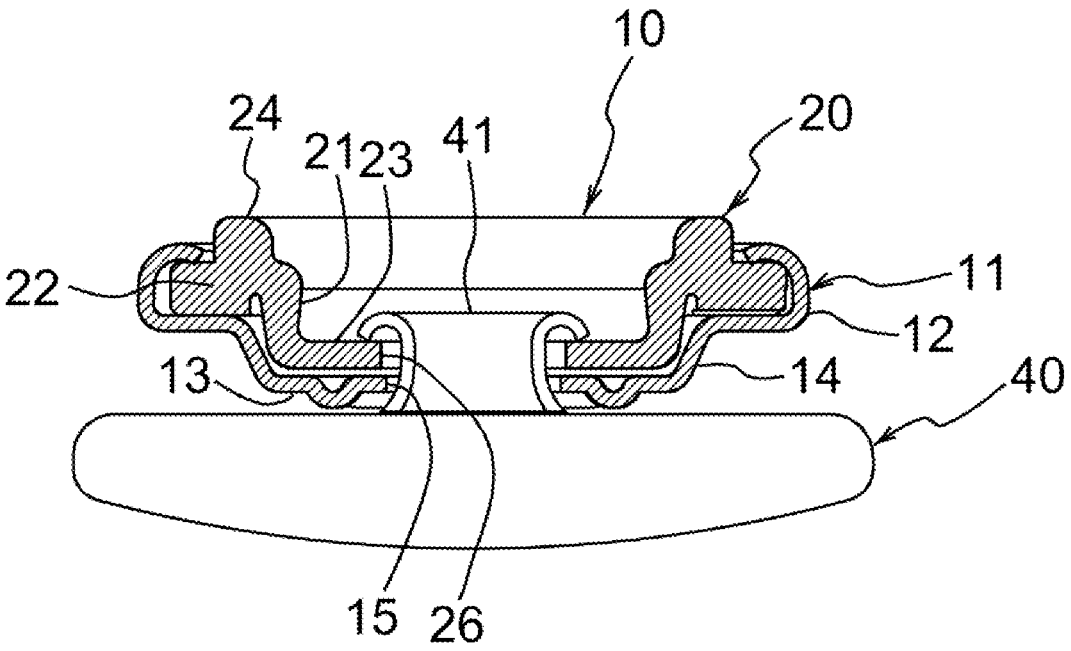
FIG. 5 is a cross-sectional view showing the female snap button when attached to fabric (not shown) by a button fastener.

FIG. 5 is a cross-sectional view showing the female snap button 10 when attached to fabric such as clothes using the button fastener 40, but the fabric is not shown. In a case in which the female snap button 10 is attached to the fabric, the shaft portion 41 of the button fastener 40 penetrates the fabric upward and then passes through the opening 15 of the female snap button 10 and the ring opening 26 to be received in the cylindrical portion 21, wherein the shaft portion 41 is crimped. Accordingly, the female snap button 10 is fixed to the fabric by the button fastener 40. In the present embodiment, since the ring bottom portion 23 substantially covers the upper surface of the bottom portion 13, the shaft portion 41 is crimped to the ring bottom portion 23. In other words, the ring bottom portion 23 receives the crimped shaft portion 41.

Figure 6:
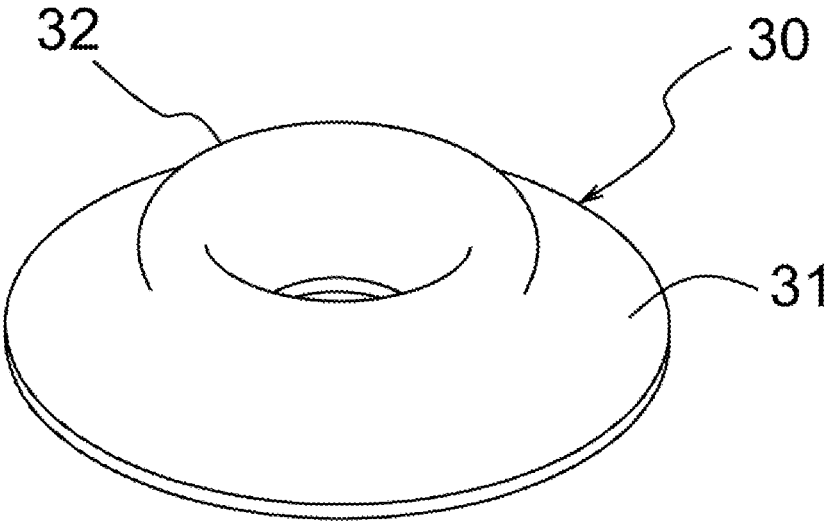
FIG. 6 is a perspective view of a male snap button.
Figure 7:
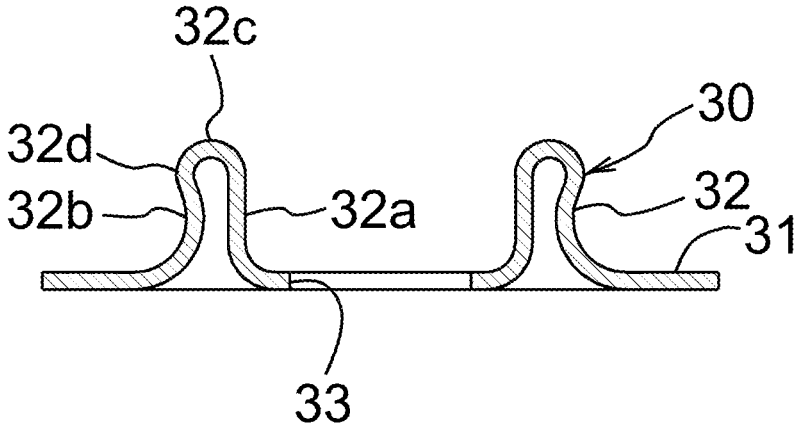
FIG. 7 is a cross-sectional view of the male snap button.

FIGS. 6 and 7 are a perspective view and a cross-sectional view of a male snap button 30 in the snap button according to an embodiment of the present invention. The male snap button 30 is formed using drawing processing and the like of a metal plate material and includes a disc-shaped base portion 31 and an engaging protuberance 32 that projects from the base portion 31. An opening 33 for passing the shaft portion 41 of the button fastener 40 is provided in the center of the base portion 31. That is, the male snap button 30 is also attached to the fabric by the button fastener 40. The engaging protuberance 32 includes an inner cylinder portion 32*a*, an outer cylinder portion 32*b*, and a connecting portion 32*c* that connects upper edges of the inner and outer connecting portions 32*a* and 32*b* in a convexly curved shape. A male-side engagement edge 32*d* having the largest outer diameter in the engaging protuberance 32 is provided in the vicinity of an upper edge of the outer cylinder portion 32*b*.

The outer diameter of the male-side engagement edge 32*d* is slightly larger than that of the female-side engagement edge 21*a* of the female snap button 10. Further, a height from the base portion 31 to an apex of the engaging protuberance 32 is the same as a height from an upper surface of the ring bottom portion 23 of the ring member 20 to the top surface 24*b* of the protruding portion 24, or is slightly lower or higher than that height. A diameter of the base portion 31 of the male snap button 30 is slightly smaller than an outer diameter of the peripheral side holding portion 12*b* which is the maximum outer diameter of the female snap body 11 of the female snap button 10 and is substantially the same as an outer diameter of the expansion upper portion 22 of the ring member 20.

Figure 8:
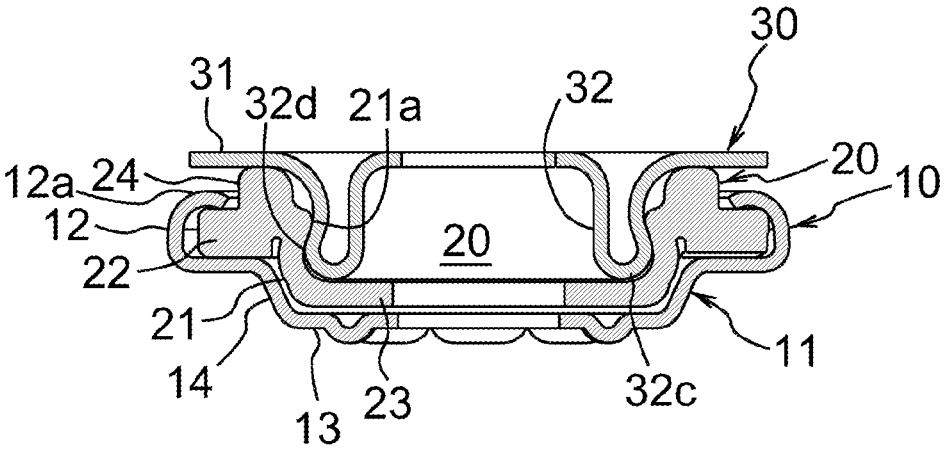
FIG. 8 is a cross-sectional view showing the female snap button and the male snap button when engaged with each other.

FIG. 8 is a cross-sectional view showing the female snap button 10 and the male snap button 30 when engaged with each other. The female snap button 10 and the male snap button 30 are engaged with each other by the engaging protuberance 32 of the male snap button 30 being inserted into the cylindrical portion 21 of the ring member 20 of the female snap button 10, that is, the engagement space 20*a*, and the engagement is released by the engaging protuberance 32 being pulled out from the cylindrical portion 21. When the engaging protuberance 32 is attached to and detached from the engagement space 20*a*, the female-side engagement edge 21*a* of the cylindrical portion 21 is temporarily expanded outward in the radial direction by the male-side engagement edge 32*d* of the engaging protuberance 32, and, when the male-side engagement edge 32*d* moves beyond the female-side engagement edge 21*a* in an axial direction, the female-side engagement edge 21*a* returns inward in the radial direction. The cylindrical portion 21 in which the engaging protuberance 32 is received is slightly expanded outward in the radial direction, and thus the cylindrical portion 21 comes into contact with the connecting portion 14 of the female snap body 11, or the gap between the cylindrical portion 21 and the connecting portion 14 is reduced. The slit 25 serves to promote the radially outward expansion of the cylindrical portion 21 in which the engaging protuberance 32 is received. Even without the slit 25, the ring member 20 made of soft resin can be elastically deformed in the radial direction.

In the engaged state of FIG. 8, the base portion 31 of the male snap button 30 is in contact with the top surface 24*b* of the protruding portion 24 of the ring member 20 of the female snap button 10, but is separated from the upper holding portion 12*a* located at the uppermost side in the female snap body 11 by substantially the height of the protruding portion 24. Further, in the engaged state, the connecting portion 32*c* which is a top portion of the engaging protuberance 32 is barely in contact with or is adjacent to the upper surface of the ring bottom portion 23 of the ring member 20. Further, the outer cylinder portion 32*b* of the engaging protuberance 32 accommodated in the cylindrical portion 21 is substantially in close contact with the inner peripheral surface of the cylindrical portion 21. Furthermore, in the engaged state, the ring bottom portion 23 which is a soft resin portion is disposed between the engaging protuberance 32 and the bottom portion 13 of the female snap body 11. As described above, in the engaged state, the male snap button 30 made of metal is in contact with only the ring member 20 made of soft resin of the female snap button 10, and is not in contact with the female snap body 11 made of metal of the female snap button 10.

Further, when the engaging protuberance 32 of the male snap button 30 is inserted into the cylindrical portion 21 of the ring member 20, that is, the engagement space 20*a*, the protruding portion 24 of the ring member 20 projects above the upper holding portion 12*a* located at the uppermost position in the female snap body 11, and thus the base portion 31 of the male snap button 30 comes into contact with the protruding portion 24 which is a soft resin portion, but does not come into contact with the female snap body 11 which is a metal portion. Further, when the engaging protuberance 32 is inserted into the engagement space 20*a*, the base portion 31 comes into contact with the protruding portion 24 to prevent further insertion. At this time, the connecting portion 32*c* of the engaging protuberance 32 which is a metal portion can come into contact with the ring bottom portion 23 which is a soft resin portion, but does not come into contact with the bottom portion 13 of the female snap body 11 which is a metal portion. Further, even when the engaging protuberance 32 is pulled out from the engagement space 20*a*, the male snap button 30 does not come into contact with the female snap body 11. The height of the protruding portion 24 is set such that when the engaging protuberance 32 is attached to and detached from the engagement space 20*a*, even if the male snap button 30 is tilted with respect to the female snap body 11 (even if an axis of the male snap button 30 deviates from an axis of the female snap body 11), the base portion 31 of the male snap button 30 does not come into contact with the female snap body 11. Further, if the ring member 20 does not have the ring bottom portion 23, when the engaging protuberance 32 of the male snap button 30 is attached to and detached from the engagement space 20*a*, that is, when the engaging protuberance 32 snaps into the female-side engagement edge 21*a* of the ring member 20, the behavior (or the displacement) of the ring member 20 becomes larger than that when the ring bottom portion 23 is present, which can lead to generation of a slight attaching/detaching sound. In the present embodiment, since the ring member 20 has the ring bottom portion 23, the behavior of the ring member 20 at the time of attachment/detachment can be suppressed, and the attaching/detaching sound also can be reduced. As shown in FIG. 5, the ring bottom portion 23 is fixed to the bottom portion 13 of the female snap body 11 by the shaft portion 41 of the button fastener 40. Therefore, the behavior of the ring member 20 at the time of attachment/detachment described above can be further suppressed, and the quietness at the time of attachment/detachment can be enhanced. From the above, in the snap button according to the present embodiment, there is no or little possibility that the male snap button 30 made of metal and the female snap body 11 made of metal come into contact with each other to generate an attaching/detaching sound.

Figure 9:
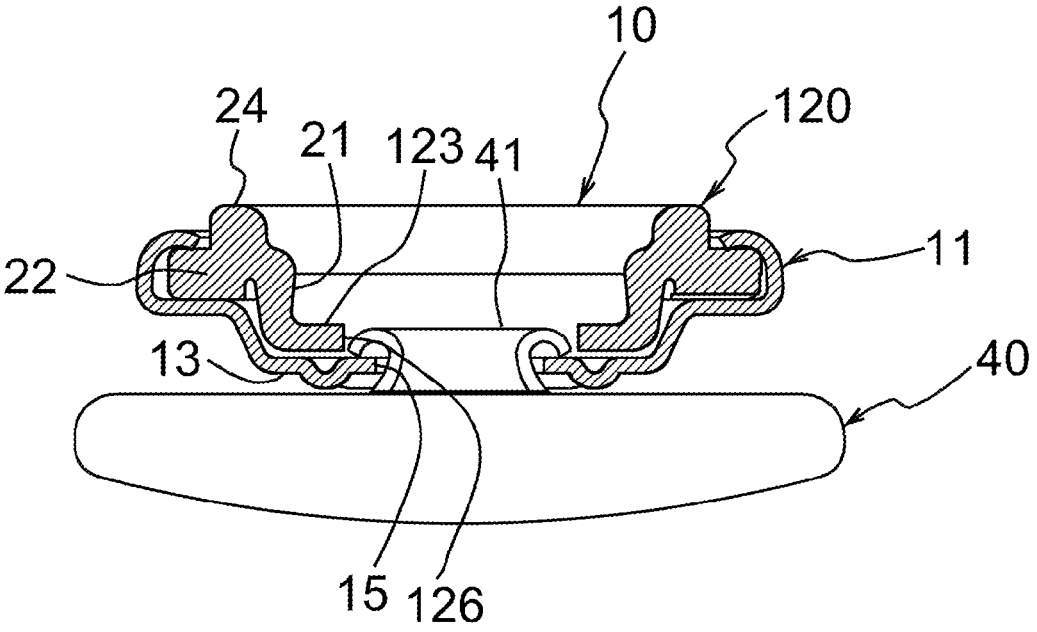
FIG. 9 is a cross-sectional view, similar to FIG. 5, showing a modification example of a ring member.

FIG. 9 is a cross-sectional view, similar to FIG. 5, showing a modification example of the ring member. The ring member 120 shown in FIG. 9 includes a ring bottom portion 123. A length of the ring bottom portion 123 extending inward from the cylindrical portion 21 in the radial direction is shorter than that of the ring bottom portion 23 described above, and to that extent, a diameter of a ring opening 126 at the center of the ring bottom portion 123 is also larger than that of the ring opening 26 described above. Since the ring opening 126 is large, the bottom portion 13 of the female snap body is partially exposed from the ring opening 126 to the engagement space 20*a* side, and in the present example, the shaft portion 41 of the button fastener 40 is crimped to the exposed portion of the bottom portion 13. The ring bottom portion 123 covers the entire upper surface of the bottom portion 13 except for a portion corresponding to the crimped shaft portion 41 in the bottom portion 13. Further, in the engaged state of the male snap button 30 and the female snap button 10, the ring bottom portion 123 is disposed between the engaging protuberance 32 and the bottom portion 13 of the female snap body 11.

Therefore, the engaging protuberance 32 does not come into contact with the bottom portion 13.

REFERENCE SIGNS LIST

10 Female snap button
11 Female snap body
12 Holding portion
12*a* Upper holding portion (end on one side)
13 Bottom portion
15 Opening
20, 120 Ring member
20*a* Engagement space
21 Cylindrical portion
22 Expansion upper portion
23, 123 Ring bottom portion
26, 126 Ring opening
30 Male snap button
31 Base portion
32 Engaging protuberance
40 Button fastener
41 Shaft portion

The invention claimed is:

1. A snap button comprising:
a male snap button (30) made of metal; and
a female snap button (10),
wherein the male snap button (30) comprises:
a base portion (31), and
an engaging protuberance (32) which projects from the base portion (31),
wherein the female snap button (10) comprises:
a ring member (20, 120) made of soft resin, defining an engagement space (20*a*) which detachably accepts the engaging protuberance (32), and
a female snap body (11) made of metal, accommodating the ring member (20, 120), and
wherein the ring member (20, 120) is provided with a protruding portion (24) made of soft resin which projects further out to one side than an end (12*a*) on the one side of the female snap body (11) facing the male snap button (30) in an axial direction, and which is provided in a circumferential direction;
wherein
in a state in which the engaging protuberance (32) of the male snap button (30) is accepted in the engagement space (20*a*) of the female snap button (10), the base portion (31) of the male snap button (30) is in contact with the protruding portion (24).

2. The snap button according to claim 1, wherein
the female snap body (11) comprises a bottom portion (13), and
the ring member (20, 120) comprises a ring bottom portion (23, 123) which is disposed between the bottom portion (13) and the engaging protuberance (32) in a state in which the engaging protuberance (32) is accepted in the engagement space (20*a*).

3. The snap button according to claim 2, wherein
the bottom portion (13) and the ring bottom portion (23, 123) each have an opening (15; 26, 126) through which a shaft portion (41) of a button fastener (40) passes, and
the shaft portion (41) is crimped to the bottom portion (13) or the ring bottom portion (23, 123).

4. A female snap button comprising:
a ring member (20, 120) made of soft resin, defining an engagement space (20*a*); and
a female snap body (11) made of metal, accommodating the ring member (20, 120),
wherein the ring member (20, 120) comprises:
a cylindrical portion (21) having the smallest inner diameter at a female-side engagement edge (21*a*) thereof; and
a protruding portion (24) made of soft resin which projects further out to one side than the female-side engagement edge (21*a*) and than an end (12*a*) on the one side of the female snap body (11) facing a male snap button (30) in an axial direction, and the protruding portion (24) is provided in a circumferential direction;
wherein the end (12*a*) on the one side of the female snap body (11) is disposed further out to the one side than the female-side engagement edge (21*a*).

5. The female snap button according to claim 4, wherein
the female snap body (11) comprises a bottom portion (13), and
the ring member (20, 120) comprises a ring bottom portion (23, 123) which covers the bottom portion (13).

6. A female snap button comprising:
a ring member (20, 120) made of soft resin, defining an engagement space (20*a*); and
a female snap body (11) made of metal, accommodating the ring member (20, 120),
wherein the ring member (20, 120) comprises:
a cylindrical portion (21) having the smallest inner diameter at a female-side engagement edge (21*a*) thereof;
an annular expansion upper portion (22) that expands outward from an upper edge of the cylindrical portion (21) in a radial direction;
a ring bottom portion (23) that extends inward from a lower edge of the cylindrical portion (21) in the radial direction; and
a protruding portion (24) which projects further out to an upper side than the female-side engagement edge (21*a*) and than an end (12*a*) on the upper side of the female snap body (11) facing a male snap button (30) in an axial direction, and the protruding portion (24) is provided in a circumferential direction, wherein the protruding portion (24) that protrudes upward from an upper surface (22*a*) of the expansion upper portion (22);
wherein the end (12*a*) on the upper side of the female snap body (11) is disposed further out to the upper side than the female-side engagement edge (21*a*).

* * * * *